United States Patent [19]

Hunt

[11] 4,443,667

[45] Apr. 17, 1984

[54] ELECTROMAGNETIC TRANSDUCER

[75] Inventor: Richard M. Hunt, Indianapolis, Ind.

[73] Assignee: Bell Telephone Laboratories, Incorporated, Murray Hill, N.J.

[21] Appl. No.: 338,231

[22] Filed: Jan. 11, 1982

[51] Int. Cl.[3] ..... H04R 11/00

[52] U.S. Cl. ..... 179/115 R; 335/235; 179/117

[58] Field of Search ..... 335/235, 229; 179/115 R, 117, 119 R, 120

[56] References Cited

U.S. PATENT DOCUMENTS

| | | | |
|---|---|---|---|
| 1,026,196 | 5/1912 | Beck | 179/114 R |
| 1,096,127 | 5/1914 | Rosenberg | 179/114 R |
| 1,642,777 | 9/1927 | Jones | 179/114 R |
| 1,738,653 | 12/1929 | Inglis et al. | 179/115 R |
| 1,980,242 | 11/1934 | Wolpert | 179/114 R |
| 2,419,697 | 4/1947 | Wolff | 179/114 R |
| 2,506,609 | 5/1950 | Mott | 179/120 |
| 2,506,624 | 5/1950 | Wirsching | 179/120 |
| 2,520,640 | 8/1950 | Kreisel | 179/114 R |
| 2,520,646 | 8/1950 | Mott | 179/115 R |
| 3,092,693 | 6/1963 | Hayasaka et al. | 179/115 R |
| 3,333,219 | 7/1967 | Marino | 335/252 |
| 3,358,089 | 12/1967 | Parker | 179/117 |
| 3,439,130 | 4/1969 | Chase et al. | 179/114 R |
| 3,497,638 | 2/1970 | Cohen | 179/115 R |
| 4,075,437 | 2/1978 | Chin et al. | 179/114 R |
| 4,246,450 | 1/1981 | Barber | 179/115.5 R |
| 4,258,234 | 3/1981 | Bordelon et al. | 179/114 |

FOREIGN PATENT DOCUMENTS

| | | | |
|---|---|---|---|
| 41-54771 | 3/1966 | Japan | 179/117 |
| 2073544 | 9/1981 | United Kingdom | 179/115 R |

OTHER PUBLICATIONS

Masayuki Murakami, Member and Mizuhiro Tobita, "Optimum Design of Electromagnetic Receivers", Electronics and Communications in Japan, vol. 52-A, No. 10, 1969, pp. 10-18.

Masayuki Murakami, Mikio Nishihata and Mizuhiro Tobita, "Electromagnetic Transducers for the Small Size Telephone Set", Review of the Electrical Communication Laboratories, vol. 22, Nos. 3-4, Mar.-Apr. 1974, pp. 284-294.

*Primary Examiner*—G. Z. Rubinson
*Assistant Examiner*—L. C. Schroeder
*Attorney, Agent, or Firm*—H. L. Newman

[57] ABSTRACT

An electromagnetic transducer is disclosed that includes a pole assembly (110) comprising a central pole piece (112) upstanding from a back plate (114). A coil assembly (120) is disposed about the central pole piece (112) and rests on the back plate (114). In addition, an inverted cup-shaped permanent magnet (130) having a central opening (132) in its base (131) is positioned so that the wall (134) of the magnet circumscribes the coil assembly (120) and rests on the back plate (114). The rim of the central opening (132) in the base (131) of the permanent magnet (130) is spaced from and encircles the upper end of the central pole piece (112). Also the wall (134) of the permanent magnet (130) is of a height that the upper surface of the base (131) lies in essentially the same plane as the upper surface of the pole piece (112). A central armature (222) is supported by a nonmagnetic diaphragm (221) so as to be positioned above and spaced from the central pole piece (112). The armature (222) lies in a plane that is essentially parallel to the plane of the upper surface of the pole piece (112), and the armature is of a size that it overlaps the portion of the base (131) of the permanent magnet (130) immediately adjacent to the central opening (132).

20 Claims, 6 Drawing Figures

ELECTROMAGNETIC TRANSDUCER

FIELD OF THE INVENTION

This invention relates to electromagnetic transducers and within that field, to central armature electromagnetic transducers having an inverted cup-shaped permanent magnet.

BACKGROUND OF THE INVENTION

Electromagnetic transducers having a central armature configuration have been known in the art since at least 1929, as shown by U.S. Pat. No. 1,738,653, issued to A. H. Inglis et al. on Dec. 10, 1929. Furthermore, electromagnetic transducers having a cup-shaped permanent magnet that is inverted with respect to the end of a pole piece at which an air gap is located, have been known in the art since at least 1950, as shown by U.S. Pat. No. 2,506,609, issued to E. E. Mott on May 9, 1950.

Still further, as seen from the disclosure of U.S. Pat. No. 1,642,777 issued to W. C. Jones on Sept. 20, 1927, it has been recognized in the art since at least 1927 that magnetic circuit efficiency is a significant consideration in the design of an electromagnetic transducer. In fact, as described in the introduction of U.S. Pat. No. 3,439,130, issued to A. J. Chase et al. on Apr. 5, 1969, magnetic circuit efficiency is the prime determinant of certain important transducer characteristics, notably its physical size and weight and the size of the air gap between the transducer armature and the adjacent pole piece. Increasing the magnetic circuit efficiency permits (1) the size and weight of the transducer to be reduced and/or (2) the size of the air gap to be increased.

A transducer of small size is desirable because it permits more freedom in the design of the structure in which the transducer is to be used. A transducer of reduced weight is important where the transducer is to be held and/or carried by the user of the transducer. Small size and weight also result in reduced material usage and thereby a reduction in the cost of the transducer. Finally, an air gap of increased size is important because it increases the stability of the transducer, and it relaxes the controls that need to be exercised during its production. Consequently, the performance of the transducer is improved and the cost of manufacturing the transducer is reduced.

Despite this recognition of the benefits resulting from higher magnetic circuit efficiency, no one prior to me recognized that the combination of a central armature configuration and an inverted cup-shaped permanent magnet provides an electromagnetic transducer that has enhanced magnetic circuit efficiency.

SUMMARY OF THE INVENTION

An electromagnetic transducer in accordance with the present invention includes a pole assembly comprising a central pole piece upstanding from a disc-shaped back plate. A coil assembly is disposed about the central pole piece and rests on the back plate. In addition, an inverted cup-shaped permanent magnet having a central opening in its base is positioned so that the wall of the magnet circumscribes the coil assembly and rests on the back plate. The rim of the central opening in the base of the permanent magnet is spaced from and encircles the upper end of the central pole piece. Also, the wall of the permanent magnet is of a height that the upper surface of the base lies in essentially the same plane as the upper surface of the pole piece. A central armature is supported by a nonmagnetic diaphragm so as to be positioned above and spaced from the central pole piece. The armature lies in a plane that is essentially parallel to the plane of the upper surface of the pole piece, and the armature is of a size that it overlaps the portion of the base of the permanent magnet immediately adjacent to the central opening.

This arrangement (1) reduces the number of nonworking air gaps, and (2) places one pole of the permanent magnet right at the working air gap between it and the armature. The combination of these two features results in a low ratio of magnet flux to working air gap flux, that is, a low flux leakage factor. It also results in a high ratio of output response level to the magnet energy required. Thus, the efficiency of the magnetic circuit is clearly enhanced by this configuration of components.

DETAILED DESCRIPTION

Figure 1:
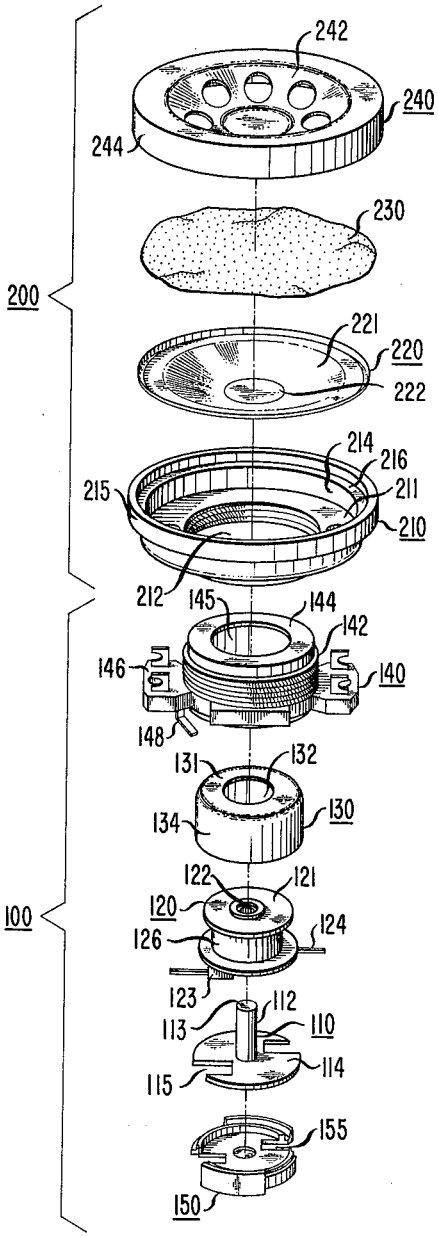
FIG. 1 is an exploded perspective view of a receiver in accordance with the present invention.
Figure 2:
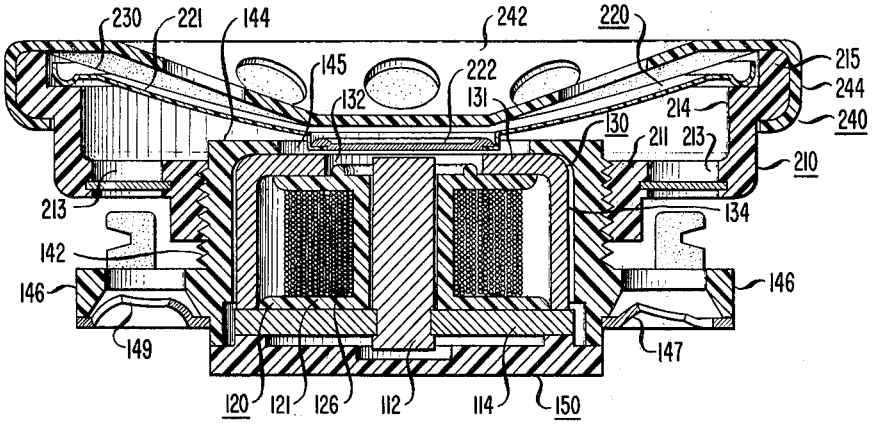
FIG. 2 is a cross-sectional view of the assembled receiver taken along line 2—2 of FIG. 3.

Referring to FIG. 1 of the drawing, a telephone-type receiver in accordance with the present invention comprises two major assemblies, a motor assembly 100 and a frame assembly 200. The motor assembly 100 includes a pole assembly 110 consisting of a cylindrical central pole piece 112 having a face 113 at its upper end and a disc-shaped back plate 114 at its lower end. While the central pole piece 112 and back plate 114 are shown in FIG. 2 to be discrete elements that are joined together, they may be advantageously formed as an integrated structure by using a sintering process. This has the benefit of eliminating a nonworking air gap between the central pole piece 112 and the back plate 114. In any case, the elements are formed from a low reluctance, noncorroding material such as permalloy. For reasons that become clear as the description proceeds, the back plate 114 is provided with a pair of opposed and offset slots 115.

Figure 3:
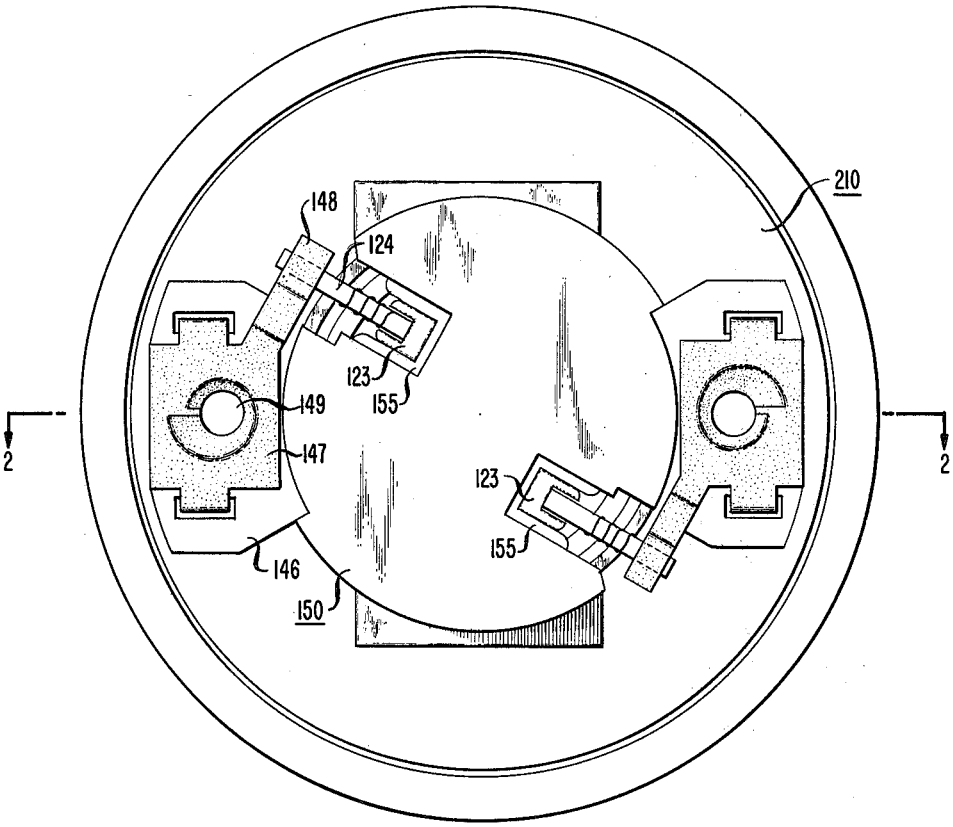
FIG. 3 is a bottom view of the receiver.

Referring now to FIGS. 1 and 2, a coil assembly 120 is positioned on the pole assembly 110. The coil assembly 120 consists of a cylindrical plastic bobbin 121 having central opening 122 that accommodates and conforms to the central pole piece 112. The bobbin 121 also has a pair of opposed and offset posts 123 that depend from the bottom flange of the bobbin, and an electrical terminal 124 is mounted in each post. The terminals 124 extend laterally in opposite directions from one another and generally parallel to the plane of the bottom flange. A coil 126 is wound on the bobbin 121 and, as shown in FIG. 3, the ends of the coil are wrapped around the terminals 124. Although not shown, the ends of the coil are advantageously also soldered to the terminals 124. The coil assembly 120 is positioned on the pole assembly 110 so that the depending posts 123 of the bobbin 121 extend into the slots 115 of the back plate 114, whereby the bottom flange of the bobbin rests on the back plate.

An inverted cup-shaped permanent magnet 130 is positioned around the coil assembly 120. The magnet 130 includes a generally flat base portion 131 having a circular central opening 132. The magnet 130 also includes a cylindrical wall portion 134 that circumscribes the coil assembly 120 and rests on the back plate 114 of the pole assembly 110. As seen from FIG. 2, the outside diameter of the wall portion 134 is approximately the same as the outside diameter of the back plate 114. In addition, the wall portion 134 is of a height that the upper surface of the base portion 131 lies in essentially the same plane as the face 113 of the central pole piece 112. In addition, the central opening 132 in the base portion 131 is of a size that the rim of the opening is spaced from the cylindrical surface of the central pole piece 112. The permanent magnet 130 is advantageously formed from magnetic materials such as disclosed in U.S. Pat. No. 4,075,437 issued to G. Y. Chin et al. on Feb. 21, 1978, U.S. Pat. No. 4,251,293 issued to S. Jin on Feb. 17, 1981, U.S. Pat. No. 4,253,883 issued to S. Jin on Mar. 3, 1981, or U.S. Pat. No. 4,258,234 issued to C. M. Bordelon et al on Mar. 24, 1981.

This combination of the pole assembly 110, coil assembly 120, and permanent magnet 130 is positioned within a generally cylindrical adapter 140. The adapter 140, which is molded from a nonconducting, nonmagnetic plastic material, includes a wall portion 142 having a threaded external surface. The inside diameter of the wall portion 142 closely conforms to the outside diameter of the wall portion 134 of the permanent magnet 130. A lip portion 144 extends inwardly from the upper end of the wall portion 142 and is of a size to overlap just the perimeter of the base portion 131 of the permanent magnet 130. A circular central opening 145 is thereby provided that is larger than and concentric to the central opening 132 in the permanent magnet 130.

A pair of diametrically opposed tabs 146 extend outwardly from the lower end of the wall portion 142 of the adapter 140. A terminal 147 is mounted in the underside of each tab 146, and is shown most clearly in FIG. 3, the terminal includes a cantilever leg 148 that extends tangentially to the wall portion 142. The legs 148 respectively underlie and, in fact, intimately engage the terminals 124 of the coil assembly 120 when the pole assembly 110, coil assembly and permanent magnet 130 combination is positioned within the adapter 140 and rotated in a counterclockwise direction. When these components are so assembled, the terminals 147 serve to retain the pole assembly 110, coil assembly 120, and permanent magnet 130 within the adapter 140. In addition, the terminals 147 are electrically connected to the coil 126, and connection to the terminals 147 is obtained by means such as a screw threaded into an opening 149 in the terminal, a spring contact, or soldered lead.

The motor assembly 100 is completed by a back cover 150 which is joined to the adapter 140 to form a housing for the pole assembly 110, coil assembly 120, and permanent magnet 130. The back cover 150, which is molded from a nonconducting, nonmagnetic plastic, includes a pair of opposed and offset slots 155 to provide access to the terminals 124 of the coil assembly 120.

The frame assembly 200 includes a cup-shaped nonconducting, nonmagnetic plastic frame 210. The frame 210 includes a base portion 211 having a threaded central opening 212 adapted to accommodate the threaded wall 142 of the adapter 140. The base portion 211 also has a pair of opposed holes 213, seen in FIG. 2, that are adapted to accommodate acoustic resistance discs. A cylindrical wall portion 214 extends upwardly from the base portion 211 and includes a flange portion 215 at its upper end that provides a shoulder 216.

A dish-shaped diaphragm assembly 220 is accommodated within the frame 210. The diaphragm assembly 220 includes a nonmagnetic diaphragm 221 that is of a size and shape for its perimeter to be seated on the shoulder 216 of the frame 210. The diaphragm 221 has a circular central opening in which a disc-shaped armature 222 is secured. The diameter of the armature 222 is slightly greater than the diameter of the central opening 132 in the permanent magnet 130. The armature 222 is formed from a high permeability material such as vanadium permendur.

The frame assembly 200 is completed by a membrane 230 and a grid 240. The membrane 230, which is formed of polyethylene or like material, is placed in front of the diaphragm assembly 220 to serve as a dust cover. The grid 240, which is a molded nonconducting, nonmagnetic plastic member, includes a dish-shaped top portion 242 and a cylindrical wall portion 244. The top portion 242 is similar in shape to the diaphragm assembly 220 and includes a plurality of acoustic openings. The diameter of the wall portion 244 is such as to accommodate and closely conform to the flange portion 215 of the frame 210, and the height of the wall portion is such that it can be formed under the flange portion of the frame to secure the grid 240 to the frame. The combination of the frame 210 and grid 240 form a housing for the diaphragm assembly 220 and membrane 230.

When the frame assembly 200 is joined to the motor assembly 100 by threading the frame 210 onto the adapter 140, the armature 222 of the diaphragm assembly 220 is positioned within the central opening 145 of the adapter 140. The armature lies in a plane that extends parallel to and is spaced from the plane of the upper surfaces of the central pole piece 112 and the base portion 131 of the permanent magnet 130. In addition, the armature 222 overlaps the base portion 131 immediately adjacent to the central opening 132 in the permanent magnet 130.

Referring now to FIG. 2, it is seen that the rim of the central opening 132 in the base portion 131 of the permanent magnet 130 is one pole, typically the north pole, of this magnet, while the lower end of the wall portion 134 is the other pole, typically the south pole, of the magnet. Consequently, substantially all of the magnet flux emanating from the north pole of the permanent magnet 130 flows through the air gap between the permanent magnet and the armature 222 and into the armature. Some of this flux flows through the armature 222 and then through the air around the outside of the permanent magnet 130 to return to the south pole of the magnet. However, most of the magnet flux flows through the armature 222 radially inward toward the center of the armature and then through the air gap between the armature and the central pole piece 112 and into the central pole piece. The magnet flux then flows through the central pole piece 112 and back plate 114 to return to the south pole of the permanent magnet 130. It is, therefore, apparent that a highly efficient magnetic circuit is provided by this structural arrangement.

In the operation of the receiver, an AC-type electrical signal, which is an analog equivalent of the audible signal to be generated by the receiver, is applied to the coil 126. A signal flux is thereby generated that emanates from the central pole piece 112. This signal flux flows through the air gap between the central pole piece 112 and the armature 222. A portion of this signal flux flows radially through the armature 222, through the air gap between the armature and the permanent magnet 130, through the permanent magnet, and through the back plate 114. This portion of the signal flux alternately aids and opposes to one degree or another the magnet flux flowing through the air gaps. The signal flux thus causes movement of the armature 222 and thereby the diaphragm 221 which generates the equivalent acoustic signal.

Because of the high reluctance of both the air gap between the armature 222 and the permanent magnet 130 and the path through the permanent magnet, a portion of the signal flux also flows through the armature and then through the air in a path that extends between the top of the armature and the bottom of the back plate 114 and traverses around the outside of the permanent magnet. Furthermore, because the adapter 140, frame 210, and grid 240 are all formed from a nonconducting, nonmagnetic plastic, no eddy currents are generated by these components that oppose this signal leakage field. Consequently, this signal leakage field is of magnitude to enable the effective use of the inductive pick-up coil associated with many hearing aids. It is therefore seen that this signal leakage field is a significant attribute of the present structural arrangement. Measurements show that the leakage field generated is equivalent to that provided by the U-type receiver that is at this time in common usage in telephones manufactured by the Western Electric Company.

It is also seen that the structural arrangement of the present invention has few components and, therefore, is less costly to manufacture than the more complex structures of the prior art. Furthermore, in the manufacture of the receiver, adjustment to obtain maximum output is simplified by the fact that the frame assembly, which contains the armature 222, is threaded onto the motor assembly 100. Thus, the two assemblies are simply rotated relative to one another in order to adjust the working air gaps between the armature 222 and the central pole piece 112 and permanent magnet 130 to achieve maximum output of the receiver. Once this is obtained, the two assemblies are locked together such as by the application of apoxy to the threads.

While the components which make up this magnetic circuit have been described in terms of a telephone receiver, the structural arrangement of these components can be used as an electrical signal generator, as in a microphone or transmitter, and as an audible signal generator, as in a sounder or tone ringer.

Figure 4:
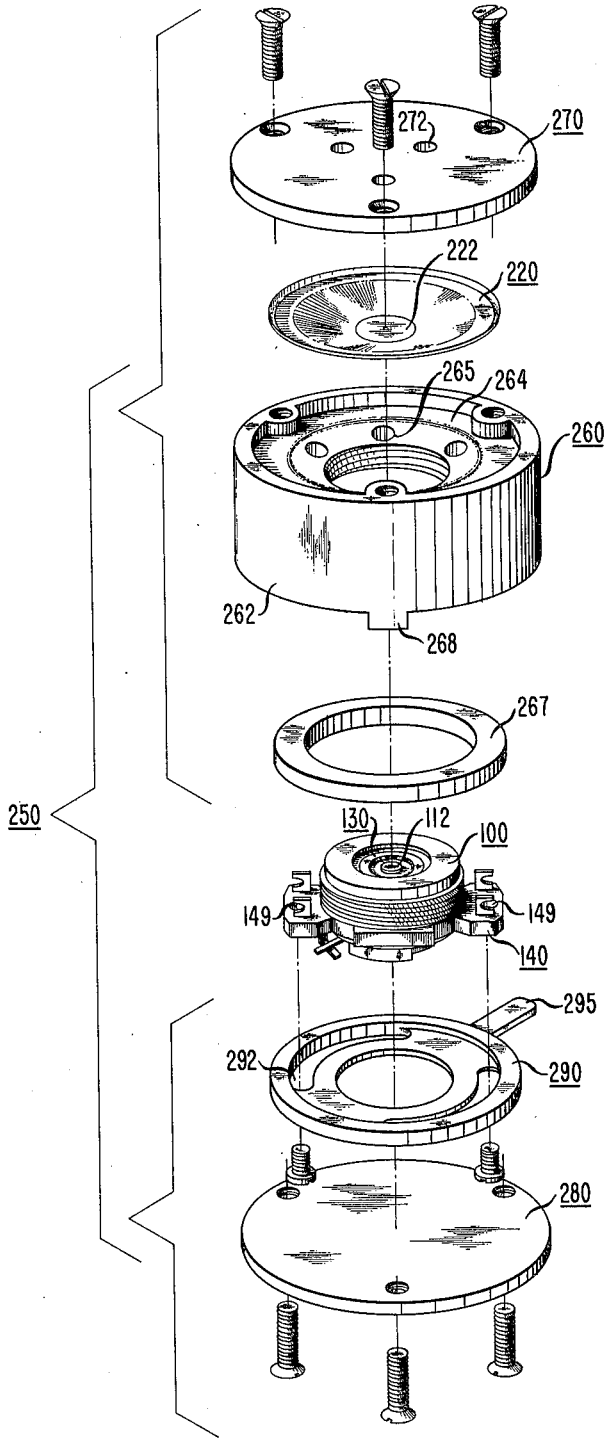
FIG. 4 is an exploded perstective view of a sounder in accordance with the present invention.
Figure 6:
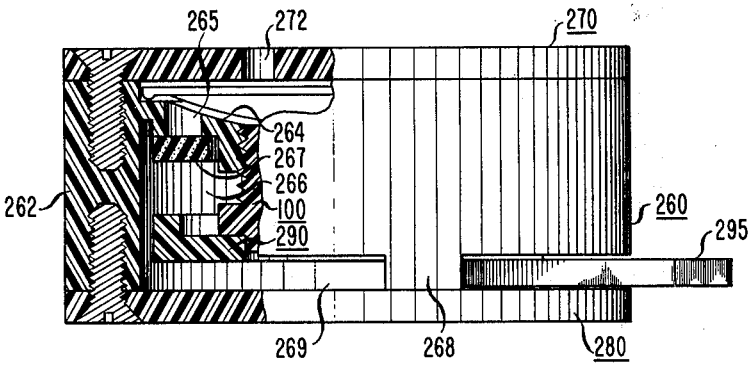
FIG. 6 is a side view of the sounder partially broken away to show the relationship of the assembled components.

Referring to FIGS. 4 and 6, a sounder in accordance with the present invention uses essentially the same motor assembly 100 as used in the receiver described above. The motor assembly 100 is, however, advantageously joined to a frame assembly 250 that provides resonant cavities for enhancing the acoustic output of the sounder. The frame assembly 250 includes a resonator frame 260 having a cylindrical outer wall portion 262. The upper end of the wall portion 262 has an inwardly extending circular flange portion 264 that provides a threaded central opening adapted to accommodate the externally threaded motor assembly 100. In addition, the upper surface of the flange portion 264 has a dish-shaped recess that is adapted to accommodate the diaphragm assembly 220 described above. A plurality of openings 265 extends through the flange portion 264 to provide communication between the diaphragm assembly 220 and a cavity 266 on the underside of the resonator frame 260. An annular member 267 of the appropriate acoustic material is joined to the underside of the flange portion 264 to provide a dirt seal for the openings 265.

The frame assembly 250 is completed by a disc-shaped front plate 270 and a disc-shaped back plate 280, respectively, fastened to the top and bottom of the resonator frame 260. The wall portion 262 of the resonator frame 260 has three downwardly extending legs 268 (only one of which is shown) equally spaced about its circumference, and the fasteners for securing the back plate to the resonator frame extends through these legs. As a result, most of the perimeter of the back plate 280 is spaced from the bottom of the wall portion 262 of the resonator frame 260 to provide openings 269. These openings provide the main sound port for the sounder. A plurality of openings 272 in the front plate 270 provides a secondary sound port. Furthermore, within this assembly the cavity 266 provides the main Helmholtz resonant cavity while the space between the diaphragm assembly 220 and the front plate 270 provides a secondary Helmholtz resonant cavity.

Figure 5:
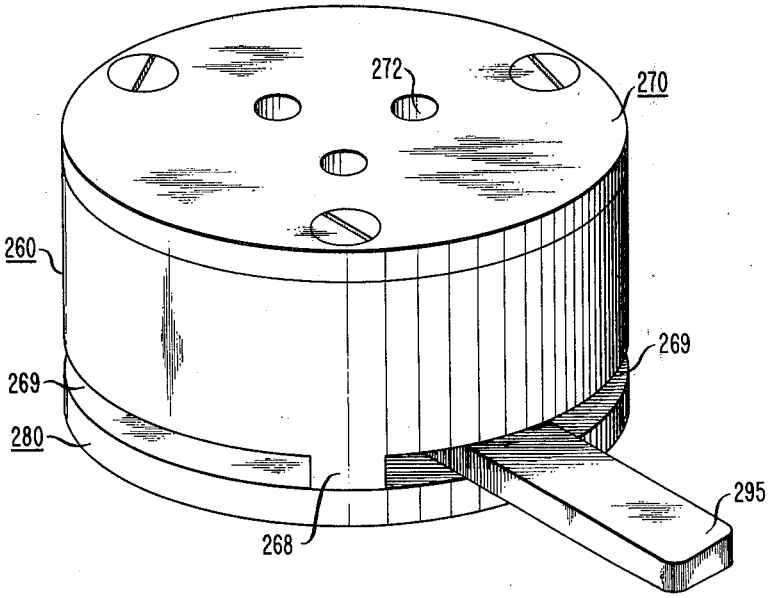
FIG. 5 is a perspective view of the sounder.

A feature of the sounder of the present invention is that volume control is readily achieved by the motor assembly 100 not being fixed to the frame assembly 250 and by the addition of a control member 290 to the underside of the motor assembly. As shown most clearly in FIG. 4, the control member 290 has an disk shape and includes a pair of opposed circular slots 292. The slots 292 are located so as to underlie the openings 149 (FIG. 3) in the terminals 147 of the tabs 146. Thus the control member 290 is readily fastened to the bottom of the adapter 140 by a pair of screws (not shown) threaded into the openings 149. The control member 290 further includes an arm portion 295 that extends out radially at its circumference. The arm portion 295 is stepped downwardly so as to extend through one of the opening 269 between the wall portion 262 of the resonator frame 260 and the back plate 280, as shown in FIGS. 5 and 6.

It is seen from FIG. 4 that once the control member 290 is fastened to the motor assembly 100, rotation of the arm portion 295 results in rotation of the motor assembly whereby the magnetic gaps between the central pole piece 112 and permanent magnet 130 of the motor assembly and the armature 222 of the diaphragm assembly 220 is changed. The acoustic output of the sounder is thereby modified. Since the travel of the arm portion 295 is limited to the distance between two of the downwardly extending legs 268 of the resonator frame 260, the slots 292 in the control member 290 are provided to enable adjustment of the control member with respect to the motor assembly 100. With this adjustment capability, the arm portion 295 can be used to vary the output of the sounder between high and low volume.

While the sounder is shown as a complete unit, the closure provided by the front plate 270 or back plate 280 may instead be provided by the housing structure in which the sounder is mounted or by a printed circuit board carrying electrical circuitry associated with the sounder. In addition, the resonator frame 260 could also be provided by this housing structure. Furthermore, while the volume control is shown as being achieved by rotating the motor assembly 200 with respect to the frame assembly 250, it could also be achieved by fixing the motor assembly to the back plate 280 or its functional equivalent and rotating the frame assembly 250. In that case, the control member 290 would be eliminated and a control arm or knurling would be added to the frame assembly 250.

Although two embodiments of my invention have been disclosed in detail, my invention is not limited thereto. Various modifications can be introduced without departing from the spirit and scope of my invention as set forth in the appended claims.

What is claimed is:

1. An electromagnetic transducer comprising a pole piece (112) including a face (113) at one end, a coil (126) disposed about the pole piece, and a central armature (222) overlying and spaced from the face of the pole piece to provide a first air gap characterized in that a cup-shaped permanent magnet (130) is disposed about the pole piece, the cup-shaped magnet having a wall portion (134) and a base portion (131) and being inverted with respect to the face end of the pole piece, the base portion having a central opening (132) that is larger than the face of the pole piece, the rim of the opening being one pole of the permanent magnet and being spaced from the central armature to provide a second air gap, the first and second air gaps being approximately equivalent.

2. An electromagnetic transducer as in claim 1 further characterized in that the rim of the central opening (132) in the base portion (131) of the inverted cup-shaped permanent magnet (130) underlies the central armature (222).

3. An electromagnetic transducer as in claim 1 further characterized in that the face end of the pole piece (112) extends within the central opening (132) in the base portion (131) of the inverted cup-shaped permanent magnet (130).

4. An electromagnetic transducer as in claim 3 further characterized in that the face (113) of the pole piece (112) and the upper surface of the rim of the base portion (131) of the inverted cup-shaped permanent magnet (130) lie in essentially the same plane.

5. An electromagnetic transducer as in claim 1 further characterized in that a back plate (114) is located at the end of the pole piece (112) opposite to the face (113) and the wall portion (134) of the inverted cup-shaped permanent magnet (130) rests on the back plate.

6. An electromagnetic transducer as in claim 5 further characterized in that the lower end of the wall portion (134) rests on the portion (114) of the back plate immediately adjacent to the perimeter of the back plate.

7. An electromagnetic transducer as in claim 5 further characterized in that the pole piece (112) and back plate (114) are integral.

8. An electromagnetic transducer as in claim 5 further characterized in that the pole piece (112), back plate (114), and inverted cup-shaped magnet (130) are contained within a first nonconducting, nonmagnetic housing (140) that screws into a second nonconducting, nonmagnetic housing (210) that contains the armature (222).

9. An electromagnetic transducer as in claim 1 further characterized in that the pole piece (112) and inverted cup-shaped permanent magnet (130) are contained within a first housing, the central armature (222) is supported by a diaphragm (221) that is contained within a second housing having at least one resonant cavity, the first housing screwing into the second housing, and means are provided for rotating one housing with respect to the other housing to vary the output of the transducer.

10. An electromagnetic transducer as in claim 1 further characterized in that the pole piece (112), coil (126), central armature (222), and inverted cup-shaped permanent magnet (130) are contained within a nonconducting, nonmagnetic structure.

11. An electromagnetic transducer comprising: a cylindrical central pole piece having a face at one end, an armature overlying and spaced from the face of the central pole piece, a coil disposed about the central pole piece, an inverted cup-shaped magnet having a cylindrical wall portion disposed about the coil and a base portion having a circular central opening larger in diameter than and concentric to the central pole piece, the rim of the opening being one pole of the permanent magnet and being adjacent to the armature, and the face of the central pole piece being adjacent to the armature.

12. An electromagnetic transducer as in claim 11 wherein the central pole piece has a disc-shaped back plate at its other end on which the wall portion of the inverted cup-shaped permanent magnet rests, the outside diameter of the wall portion of the permanent magnet being approximately the same as the outside diameter of the back plate.

13. An electromagnetic transducer as in claim 12 wherein the central pole piece and back plate are an integrated structure.

14. An electromagnetic transducer as in claim 11 wherein the base portion of the inverted cup-shaped permanent magnet is generally flat and the upper surface of the base portion lies in essentially the same plane as the face of the central pole piece.

15. An electromagnetic transducer as in claim 11 wherein the armature overlies both the central pole piece and the rim of the central opening in the base portion of the inverted cup-shaped permanent magnet.

16. An electromagnetic transducer comprising a central pole piece including a face at one end, a coil disposed about the central pole piece, an armature overlying and spaced from the face of the central pole piece, and a cup-shaped permanent magnet disposed about the coil and the central pole piece, the cup-shaped magnet having a wall portion and a base portion and being inverted with respect to the face end of the central pole piece, the base portion having a central opening within which the face end of the central pole piece is centrally located, the rim of the opening being one pole of the permanent magnet and being adjacent to the armature.

17. An electromagnetic transducer as in claim 16 wherein the armature overlaps the face of the central pole piece and the rim of the central opening in the base of the inverted cup-shaped permanent magnet.

18. An electromagnetic transducer as in claim 15 wherein the face end of the central pole piece extends within the central opening in the base portion of the inverted cup-shaped permanent magnet.

19. An electromagnetic transducer as in claim 18 wherein the face of the central pole piece and the upper surface of the base portion of the inverted cup-shaped permanent magnet lie in essentially the same plane.

20. An electromagnetic transducer as in claim 16 wherein the central pole piece and inverted cup-shaped permanent magnet are contained within a first housing, the armature is supported by a second housing having at least one resonant cavity, the first housing screwing into the second housing, and means are provided for rotating one housing with respect to the other housing to vary the output of the transducer.

* * * * *